US009848685B2

(12) United States Patent
Hwang

(10) Patent No.: US 9,848,685 B2
(45) Date of Patent: Dec. 26, 2017

(54) TUBULAR CASE FOR COSMETICS

(71) Applicant: Jae Kwang Hwang, Seoul (KR)

(72) Inventor: Jae Kwang Hwang, Seoul (KR)

( * ) Notice: Subject to any disclaimer, the term of this patent is extended or adjusted under 35 U.S.C. 154(b) by 21 days.

(21) Appl. No.: 14/894,334

(22) PCT Filed: May 14, 2014

(86) PCT No.: PCT/KR2014/004334

§ 371 (c)(1),
(2) Date: Nov. 25, 2015

(87) PCT Pub. No.: WO2014/193106

PCT Pub. Date: Dec. 4, 2014

(65) Prior Publication Data

US 2017/0035181 A1 Feb. 9, 2017

(51) Int. Cl.

| | |
|---|---|
| ***A46B 11/00*** | (2006.01) |
| ***A45D 34/04*** | (2006.01) |
| ***A46B 9/02*** | (2006.01) |
| ***A46B 17/04*** | (2006.01) |
| *B65D 51/32* | (2006.01) |

(52) U.S. Cl.

CPC ..... *A45D 34/042* (2013.01); *A46B 9/021* (2013.01); *A46B 11/001* (2013.01); *A46B 11/0086* (2013.01); *A46B 17/04* (2013.01); *B65D 51/32* (2013.01)

(58) Field of Classification Search

CPC ..... A46B 11/0086
USPC ..... 401/278
See application file for complete search history.

(56) References Cited

U.S. PATENT DOCUMENTS 7,296,945 B1 * 11/2007 Byun ..... A45D 34/042 132/313
7,377,711 B2 * 5/2008 Byun ..... A45D 34/042 401/269

FOREIGN PATENT DOCUMENTS

| | | | |
|---|---|---|---|
| JP | 2006-263464 | A | 10/2006 |
| JP | 2008-023310 | A | 2/2008 |
| JP | 2008-080087 | A | 4/2008 |
| KR | 10-0626174 | | 9/2006 |
| KR | 20-0436166 | Y1 | 6/2007 |
| KR | 10-2010-0117374 | A | 11/2010 |

* cited by examiner

*Primary Examiner* — David Walczak
*Assistant Examiner* — Joshua Wiljanen
(74) *Attorney, Agent, or Firm* — Lucem, PC; Heedong Chae

(57) ABSTRACT

The present invention relates to a tubular case for cosmetics that includes: a case (10) made of a material that can be pressed by a hand and capable of keeping make-up; a cosmetic discharge member (20) thread-fastened to an inlet (11) to the top of the case (10); a cylindrical brush cap (40) fitted on the cosmetic discharge member (20), moved up/down by elastic force of a spring (30) therein, and keeping a brush (41) on the top; and an upper cap (50) covering the top of the cylindrical brush cap (40) and thread-fastened to the lowermost stepped side (21) of the cosmetic discharge member (20). According to the tubular case for cosmetics of the present invention, since an opening/closing protrusion is inserted in close contact in a discharge hole and an O-ring is fitted on an upper stepped portion of a cosmetic discharge member to seal the inner side of a lower cylindrical protrusion, make-up is prevented from leaking.

5 Claims, 5 Drawing Sheets

TUBULAR CASE FOR COSMETICS

CROSS-REFERENCE TO RELATED APPLICATION

This application claims the benefit of Korean Application No. 10-2013-0061776 filed on May 30, 2013 with the Korean Intellectual Property Office, the disclosure of which is incorporated herein by reference.

TECHNICAL FIELD

The present invention relates to a tubular case for cosmetics, and more particularly, to a tubular case for cosmetics in which an opening/closing protrusion is inserted in close contact in a discharge hole to prevent leakage of make-up and an O-ring is fitted on an upper stepped portion of a cosmetic discharge member to seal the inner side of a lower cylindrical protrusion.

BACKGROUND ART

A cosmetic container that discharges make-up in the container has been disclosed in Korean Patent Application NO. 2009-83088, in which an inlet having an anti-slide protrusion and a thread is formed at the top of the container, a flange-shaped packing body with an insertion hole at the center is inserted in the inlet, a guide groove having a center hole at the top is formed, a position control member having a thread and an anti-slide protrusion therein and a coupling ring having a locking groove around a bar having a discharge hole at the top are vertically disposed, an inlet communicating with the discharge hole of the bar is formed through the bottom, an embedding pipe with a brush embedded is fitted on a holder by coupling a rotary member having a stopper and a guide protrusion, and is inserted in a receiving groove of a fixing member having a fitting groove around the lower end and a locking protrusion at the upper end. When the cosmetic container is used, the packing body and the position control member are fixed at the upper portion of the container and the rotary body that rotates a distance corresponding to the size of the guide groove on a position control member is rotated, so the inlet at the lower end of the bar vertically disposed at the upper portion of the rotary body opens/closes an opening at the lower end of the insertion groove formed at the center of the packing body, and accordingly, make-up in the container is discharged and blocked.

This cosmetic container of the related art has a complicated structure, so the manufacturing cost is high, and there are many parts, so assembling the parts takes large labor costs and it is not economical. Further, when it is used, the make-up in the container is supposed to go through a phased line from the opening of the insertion groove formed in the packing body to the discharge hole of the rotary body, so the make-up stops in the phased discharge line and cannot be smoothly discharged, or the make-up leaks due to unstable sealing while the container is carried.

DISCLOSURE

Technical Problem

The present invention has been made in effort to solve the problems and an object of the present invention is to provide a tubular case for cosmetics in which an opening/closing protrusion is inserted in close contact with a discharge hole to prevent leakage of make-up and an O-ring is fitted on an upper stepped portion of a cosmetic discharge member to seal the inner side of the lower cylindrical protrusion.

Technical Solution

A tubular case for cosmetics according to a first embodiment of the present invention includes: a case made of a -material that can be pressed by a hand and capable of keeping make-up; a cosmetic discharge member thread-fastened to an inlet to the top of the case; a cylindrical brush cap fitted on the cosmetic discharge member, moved up/down by elastic force of a spring therein, and keeping a brush on the top; and an upper cap covering the cylindrical brush cap and thread-fastened to the lowermost stepped side of the cosmetic discharge member.

Advantageous Effects

According to the tubular case for cosmetics of the present invention, since an opening/closing protrusion is inserted in close contact in a discharge hole and an O-ring is fitted on an upper stepped portion of a cosmetic discharge member to seal the inner side of a lower cylindrical protrusion, make-up is prevented from leaking.

BEST MODE

The present invention provides a lobular case tor cosmetics that includes: a case made of a material that can be pressed by a hand and capable of keeping make-up; a cosmetic discharge member thread-fastened to an inlet to the top of the case; a cylindrical brush cap fitted on the cosmetic discharge member, moved up/down by elastic force of a spring therein, and keeping a brush on the top; and an upper cap covering the top of the cylindrical brush cap and thread-fastened to the lowermost stepped portion of fee cosmetic discharge member.

Mode For Invention

Hereinafter, exemplary embodiments of the present invention will be described in detail wife reference to the accompanying drawings. In the description of fee present invention, well-known configurations or functions are not described in detail when it is determined that they may make the spirit of the present invention unclear.

[Embodiment 1]

Figure 1:
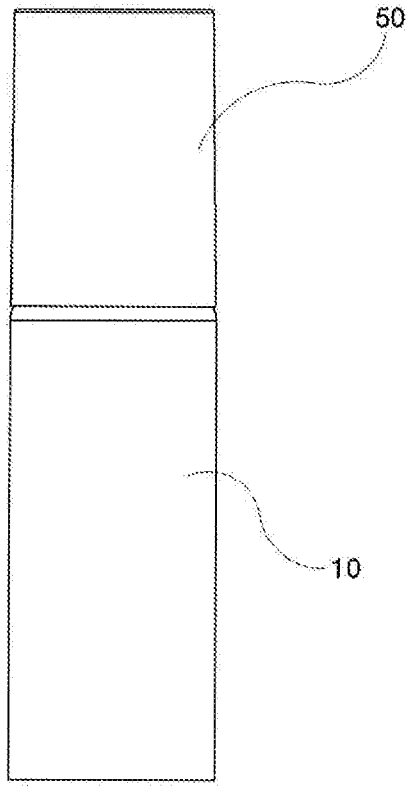
FIG. 1 is a view illustrating the external appearance of a tubular case for cosmetics of the present invention.
Figure 2:
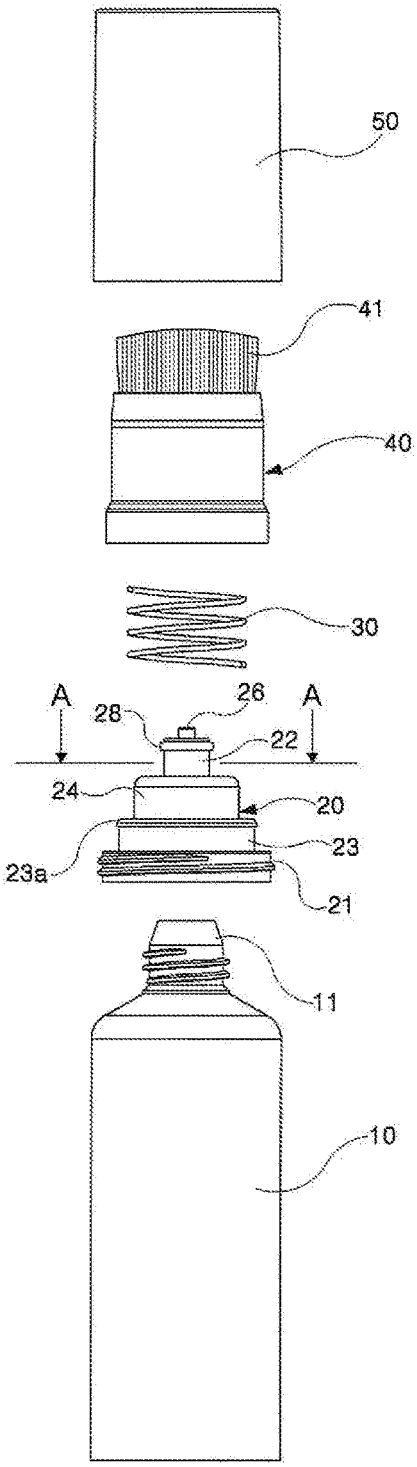
FIG. 2 is an exploded perspective view illustrating the tubular case for cosmetics of the present invention.
Figure 3:
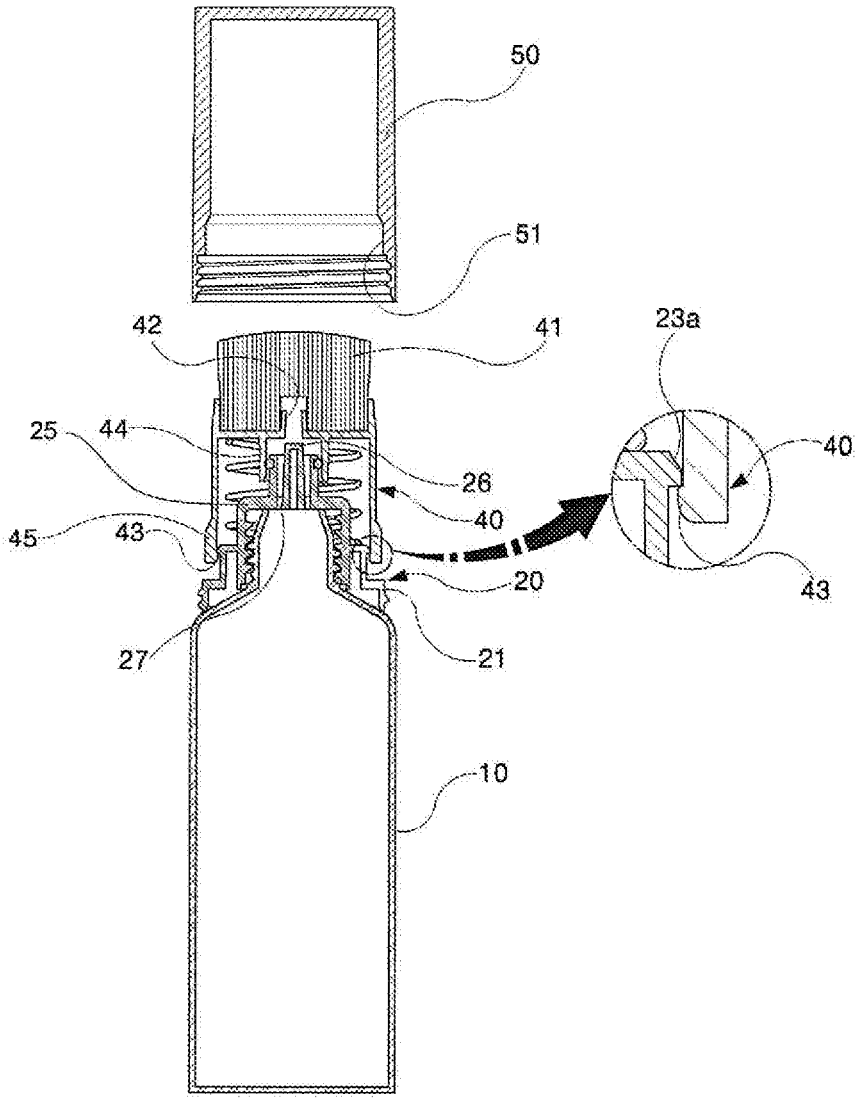
FIG. 3 is a cross-sectional view illustrating the tubular case for cosmetics of the present invention that is open.
Figure 4:
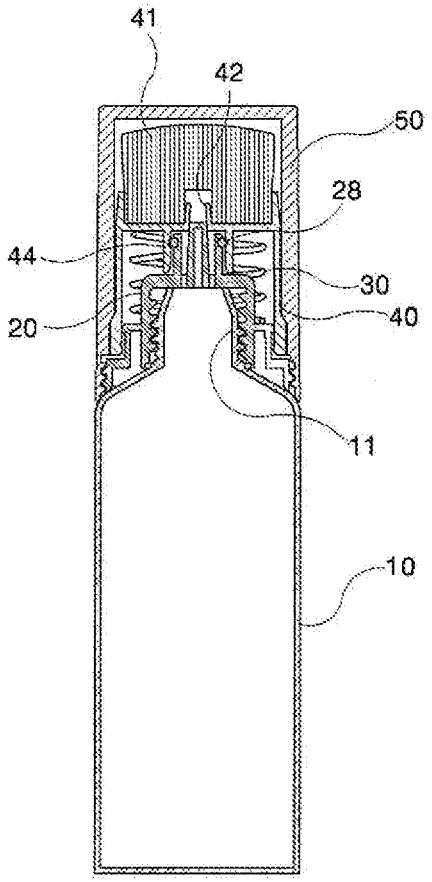
FIG. 4 is a cross-sectional view illustrating the tubular case for cosmetics of the present invention that is closed.
Figure 5:
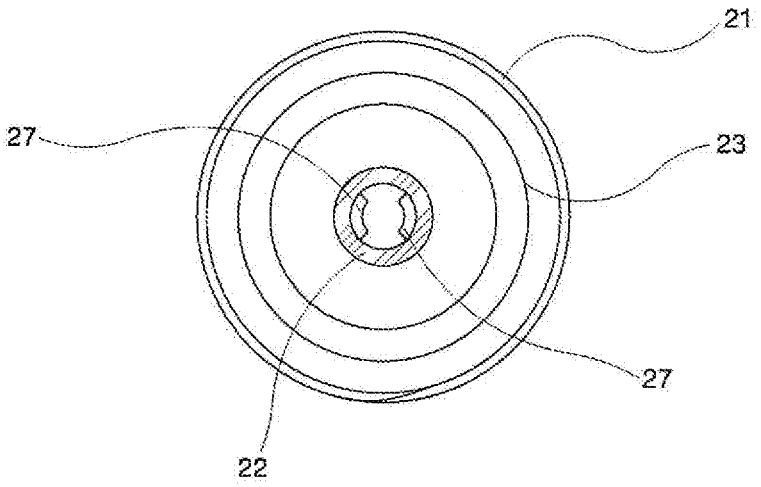
FIG. 5 is a cross-sectional view takes along line A-A in FIG. 2.

FIG. 1 is a view illustrating the external appearance of a tabular case for cosmetics of the present invention, FIG. 2 is an exploded perspective view illustrating the tubular case for cosmetics of the present invention, FIG. 3 is a cross-sectional view illustrating the tubular case for cosmetics of the present invention that is open, FIG. 4 is a cross-sectional view illustrating the tubular case for-cosmetics of the present invention that is closed, and FIG. 5 is a cross-sectional view taken along line A-A in FIG. 2.

As illustrated in FIGS. 1 to 5, a tabular ease for cosmetics of the present invention includes: a case 10 made of a material that can be pressed by a hand and capable of keeping make-up; a cosmetic discharge member 20 thread-fastened to an inlet 11 to the top of the case 10; a cylindrical brush cap 40 fitted on the cosmetic discharge member 20, moved up/down by elastic force of a spring 30 therein, and keeping a brush 41 on the top; and an upper cap 50 covering the top of the cylindrical brush cap 40 and thread-fastened to the lowermost stepped portion 21 of the cosmetic discharge member 20.

The cosmetic discharge member 20 fanned in a cylindrical shape has first and second stepped portions 23 and 24 of which the diameters decreases from the lowermost stepped portion 21 to the upper stepped portion 22, a ring-shaped packing 25 fitted on the bottom of the upper stepped portion 22 to prevent make-up from leaking out of the case 10, a circular bar-shaped opening/closing protrusion 26 protruding through the center of the top front the bottom inside the upper stepped portion 22, and a plurality of holes 27 formed symmetrically to each other such that make-up is discharged around the opening/closing protrusion 26.

The cylindrical brush cap 40 has: a discharge hole 42 formed such that make-up is discharged to the center of the lower end of the brush 21 kept at the center of the top of the brash cap and permeates into the brush 21; a circular protrusion 43 formed around the bottom inside the brush cap and locked to an outer circular protrusion 23*a* formed around the upper portion of the first stepped portion 23 of the cosmetic discharge member 20; a lower cylindrical protrusion 44 cylindrically protruding under the top where the brush 41 is kept and receiving the upper stepped portion 22 of the cosmetic discharge member 20; and an outer stepped portion 45 partially protruding at a lower portion to be moved down by a stepped groove 51 formed around the inner side of an upper cap 50 when it is covered by the upper cap 50.

An O-ring 28 is fitted on the upper portion of the upper stepped portion 22 to seal the inner side of the lower cylindrical protrusion 44.

Next, operation of the tubular case for cosmetics of the present invention having the configuration described above is described.

First, when the upper cap 50 is opened, the cylindrical brush cap 40 pressed by the stepped groove 51 formed around the inner side of the upper cap 50 is moved up by elastic force of the spring 30 and accordingly the opening/closing protrusion 26 is separated out of the discharge hole 42.

In this state, when the case 10 is pressed, make-up therein is discharged through the discharge hole and permeates into the brush, so a user can put the make-up on his/her face using the brush 41.

As described above, since a user makes up using the brush 41, it is possible to prevent the problem in the related art that when a user puts on make-up with a hand, the make-up permeates into the hand and loses before being put on a lace and is contaminated by the hand. Further, since the opening/closing protrusion is inserted in close contact in the discharge hole and the inner side of the lower cylindrical protrusion is sealed by fitting an O-ring on the upper stepped portion of the cosmetic discharge member, make-up is prevented from leaking.

As described above, although detailed embodiments of the present invention were described above, the present invention may be easily modified by those skilled in the art and those modifications should be construed as being included in the spirit of the present invention described is claims.

The invention claimed is:

1. A tubular case for cosmetics comprising:

a case (10) made of a material that can be pressed by a hand and capable of keeping make-up;

a cosmetic discharge member (20) thread-fastened to an inlet (11) on the top of the case (10);

a cylindrical brush cap (40) fitted on the cosmetic discharge member (20), moved up/down by elastic force of a spring (30) therein, and keeping a brush (41) on the top; and an upper cap (50) covering the top of the cylindrical brush cap (40) and thread-fastened to a lowermost stepped side (21) of the cosmetic discharge member (20), wherein the cosmetic discharge member (20) which is formed in a cylindrical shape has:

first and second stepped portions (23, 24) of which the diameters decrease from a lowermost stepped portion (21) to an upper stepped portion (22);

a ring-shaped packing (25) fitted on the bottom of the upper stepped portion (22) to prevent make-up from leaking out of the case (10);

a circular bar-shaped opening/closing protrusion (26) protruding through the center of the top from the bottom inside the upper stepped portion (22); and a plurality of holes (27) formed symmetrically to each other such that make-up is discharged around the opening/closing protrusion (26).

2. The tubular case for cosmetics of claim 1, wherein the cylindrical brush cap (40) has:

a discharge hole (42) formed such that make-up is discharged to the center of the lower end of the brush (21) kept at the center of the top of the brush cap and permeates into the brush (21);

a circular protrusion (43) formed around the bottom inside the brush cap and looked to an outer circular protrusion (23*a*) formed around the upper portion of the first stepped portion (23) of the cosmetic discharge member (20);

a lower cylindrical protrusion (44) cylindrically protruding under the top where the brush (41) is kept and receiving the upper stepped portion (22) of the cosmetic discharge member (20); and an outer stepped portion (45) partially protruding at a lower portion to be moved down by a stepped groove (51) formed around the inner side of the upper cap (50) when it is covered by the upper cap (50).

3. The tubular case for cosmetics of claim 2, wherein an O-ring (28) is fitted on the upper portion of the upper stepped portion (22) to seal the inner side of the lower cylindrical protrusion (44).

4. The tubular case for cosmetics of claim 1, wherein the cylindrical brush cap (40) has:

a discharge hole (42) formed such that make-up is discharged to the center of the lower end of the brush (21) kept at the center of the top of the brush cap and permeates into the brush (21);

a circular protrusion (43) formed around the bottom inside the brush cap and locked to an outer circular protrusion (23*a*) formed around the upper portion of a first stepped portion (23) of the cosmetic discharge member (20);

a lower cylindrical protrusion (44) cylindrically protruding under the top where the brush (41) is kept and receiving the upper stepped portion (22) of the cosmetic discharge member (20); and an outer stepped portion (45) partially protruding at a lower portion to be moved down by a stepped groove (51) formed around the inner side of the upper cap (50) when it is covered by the upper cap (50).

5. The tubular case for cosmetics of claim 4, wherein an O-ring (28) is fitted on the upper portion of the upper stepped portion (22) to seal the inner side of the lower cylindrical protrusion (44).

* * * * *